US012338727B2

(12) United States Patent
Katayama

(10) Patent No.: US 12,338,727 B2
(45) Date of Patent: Jun. 24, 2025

(54) SYSTEMS AND METHODS FOR AZIMUTH DETERMINATION WHILE DRILLING

(71) Applicant: Schlumberger Technology Corporation, Sugar Land, TX (US)

(72) Inventor: Makito Katayama, Clamart (FR)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/690,973

(22) PCT Filed: Jan. 4, 2023

(86) PCT No.: PCT/US2023/060075
§ 371 (c)(1),
(2) Date: Mar. 11, 2024

(87) PCT Pub. No.: WO2023/133395
PCT Pub. Date: Jul. 13, 2023

(65) Prior Publication Data

US 2024/0392680 A1 Nov. 28, 2024

Related U.S. Application Data

(60) Provisional application No. 63/266,388, filed on Jan. 4, 2022.

(51) Int. Cl.
*E21B 47/01* (2012.01)
*E21B 47/024* (2006.01)

(52) U.S. Cl.
CPC ..... *E21B 47/01* (2013.01); *E21B 47/024* (2013.01)

(58) Field of Classification Search
None
See application file for complete search history.

(56) References Cited

U.S. PATENT DOCUMENTS

| | | | | |
|---|---|---|---|---|
| 2009/0119937 | A1* | 5/2009 | Watson | G01C 19/56 33/324 |
| 2010/0198518 | A1* | 8/2010 | Ekseth | E21B 47/022 702/6 |
| 2011/0197460 | A1 | 8/2011 | Magosaki | |
| 2013/0211723 | A1 | 8/2013 | Weston | |
| 2018/0045850 | A1 | 2/2018 | Smidth | |
| 2018/0128643 | A1 | 5/2018 | Ledroz | |
| 2021/0040839 | A1* | 2/2021 | Tackmann | E21B 47/0236 |

FOREIGN PATENT DOCUMENTS

| | | | |
|---|---|---|---|
| CN | 102536207 | A | 7/2012 |
| EP | 2927419 | A1 | 10/2015 |
| WO | 2005100916 | A1 | 10/2005 |

* cited by examiner

*Primary Examiner* — Dany E Akakpo

(57) ABSTRACT

A survey tool includes a gyroscope and an accelerometer. The gyroscope can include a multi-axis gyroscope, a reciprocating gyroscope, or a combination thereof. The survey tool is independently rotatable relative to an outer housing and collects gyroscopic measurements and accelerometer measurements during drilling activities. Using the gyroscopic measurements and the accelerometer measurements, the survey tool calculates earth rate components of the rotation of the earth. Using the earth rate components, the survey tool determines the azimuth of the downhole tool.

18 Claims, 5 Drawing Sheets

SYSTEMS AND METHODS FOR AZIMUTH DETERMINATION WHILE DRILLING

CROSS-REFERENCE TO RELATED APPLICATIONS

This application claims the benefit of, and priority to, U.S. Patent Application No. 63/266,388, filed Jan. 4, 2022, which application is expressly incorporated herein by this reference in its entirety.

BACKGROUND

Modern drilling operations may change the trajectory of a wellbore through the process of directional drilling. While drilling, a driller may determine the location or drilling trajectory of a bottomhole assembly (BHA). Survey instruments located on the BHA may be used to measure direction (e.g., azimuth and inclination), and other survey information. At least one survey instrument may include a gyroscopic sensor, such as a Micro-ElectroMechanical Systems (MEMS) gyroscope. The MEMS gyroscope may be located on a downhole tool in the BHA. A downhole tool may further include one or more accelerometers that measure acceleration data about one or more axes. Using one or both of the gyroscopic motion data and the accelerometer acceleration data, the downhole tool may determine direction information, including azimuth and inclination of the downhole tool.

SUMMARY

In some embodiments, a method for performing a downhole survey includes rotating a downhole tool and stabilizing a survey package relative to an external reference. One or more gyroscopic and accelerometer measurements are received from the survey package. While the downhole tool is rotating, a method include determining an earth rate rotational component from the gyroscopic and accelerometer measurements. Based on the earth rate component, a tool azimuth of the downhole tool may be determined while the downhole tool is rotating. Optionally, the downhole tool is rotating during a drilling operation.

In some embodiments, a method for performing a downhole survey includes rotating a survey tool at the different rate than a downhole tool. While rotating the survey tool at the different rate than the downhole tool, a tool face angle is obtained and a y-axis earth rate component is determined. Determining the y-axis earth rate component includes receiving y-axis and z-axis gyroscopic measurements. Based on the y-axis and z-axis gyroscopic measurements and the tool face angle, the y-axis earth rate component is calculated. Also while rotating the survey tool at a different rate than the downhole tool, an x-axis earth rate component is determined. Determining the x-axis earth rate component includes receiving x-axis gyroscopic measurements and receiving flipped x-axis gyroscope measurements in a second direction. Based on the x-axis gyroscopic measurements, the flipped x-axis gyroscope measurements, and the tool face angle, the x-axis earth rate component may be calculated. Based on the x-axis earth rate component and the y-axis earth rate component, the tool azimuth may be determined. Optionally, the tool face angle is obtained as part of determining the y-axis earth rate component, determining the x-axis earth rate component, or as part of both of determining the y-axis earth rate component and determining the x-axis earth rate component. To allow rotation of the survey tool at the different rate than the downhole tool, the survey tool can be fully or partially independently rotatable relative to the downhole tool.

In some embodiments, a downhole drilling system includes a downhole tool including an outer housing. A survey tool is located in an interior of the outer housing. The survey tool is rotatable independent of the downhole tool. The survey tool includes a gyroscopic sensor and an accelerometer. The downhole drilling system includes a processor and memory, the memory including instructions which, when accessed by the processor, cause the processor to receive x-axis gyroscopic measurements, y-axis gyroscopic measurements, z-axis gyroscopic measurements, and tool face angle while the survey tool is rotating. The earth rate components are calculated based on the x-axis gyroscopic measurements, the y-axis gyroscopic measurements, the z-axis gyroscopic measurements, and the tool face angle. The azimuth of the downhole tool is determined using the earth rate components while the survey tool is rotating independent of the downhole tool.

This summary is provided to introduce a selection of concepts that are further described in the detailed description. This summary is not intended to identify key or essential features of the claimed subject matter, nor is it intended to be used as an aid in limiting the scope of the claimed subject matter. Additional features and aspects of embodiments of the disclosure will be set forth herein, and in part will be obvious from the description, or may be learned by the practice of such embodiments.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which.

DETAILED DESCRIPTION

This disclosure generally relates to devices, systems, and methods for performing directional surveys during drilling operations. In particular, this disclosure includes mechanisms to detect the rotation of the earth while performing downhole drilling activities. A y-axis earth rate component is detected by collecting gyroscopic measurements while rotating a survey package including one or more gyroscopes, one or more accelerometers, or one or more of both gyroscopes and accelerometers. The collected readings may then be used to calculate the y-axis earth rate component. An x-axis earth rate component is detected by collecting gyroscopic measurements from an indexing gyroscope and using those measurements to calculate the x-axis earth rate component. Using the x-axis and y-axis earth rate components, an azimuth for the downhole drilling tool may be determined. Detecting the drilling tool azimuth during drilling activities may be used to provide one or more of increasing the control of the drilling tool's trajectory or reducing drilling delays from performing a survey while the downhole tool is not operating.

Figure 1:
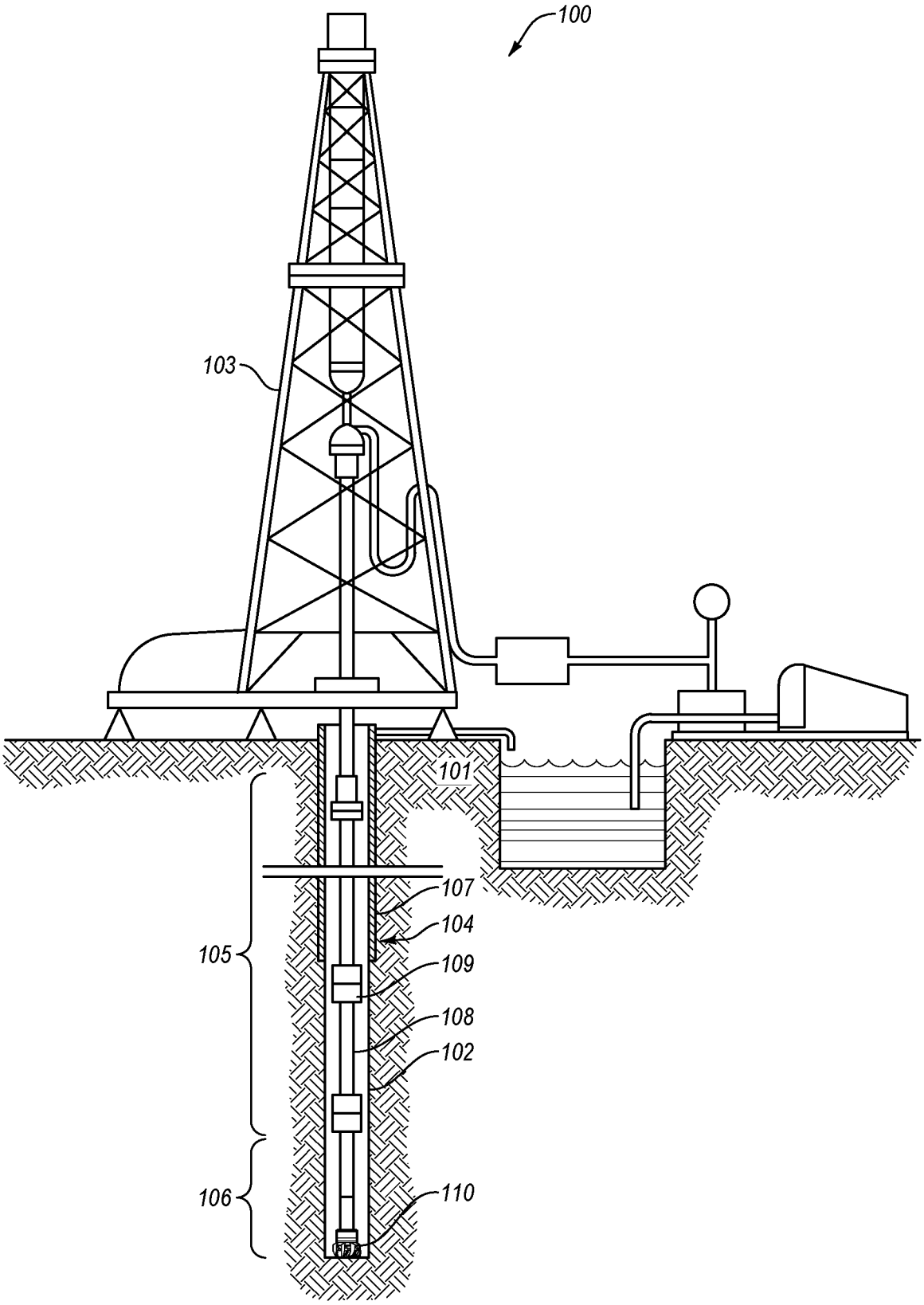
FIG. 1 is a schematic representation of a drilling system, according to at least one embodiment of the present disclosure.

FIG. 1 shows one example of a drilling system 100 for drilling an earth formation 101 to form a wellbore 102. The drilling system 100 includes a drill rig 103 used to turn a drilling tool assembly 104 which extends downward into the wellbore 102. The drilling tool assembly 104 may include a drill string 105, a bottomhole assembly (BHA) 106, and a bit 110, attached to the downhole end of drill string 105.

The drill string 105 may include several joints of drill pipe 108 connected end-to-end through tool joints 109. The drill string 105 transmits drilling fluid through a central bore and transmits rotational power from the drill rig 103 to the BHA 106. In some embodiments, the drill string 105 may further include additional components such as subs, pup joints, etc. The drill pipe 108 provides a hydraulic passage through which drilling fluid is pumped from the surface. The drilling fluid discharges through selected-size nozzles, jets, or other orifices in the bit 110 for the purposes of cooling the bit 110 and cutting structures thereon, and for lifting cuttings out of the wellbore 102 as it is being drilled.

The BHA 106 may include the bit 110 or other components. An example BHA 106 may include additional or other components (e.g., coupled between to the drill string 105 and the bit 110). Examples of additional BHA components include drill collars, stabilizers, measurement-while-drilling (MWD) tools, logging-while-drilling (LWD) tools, gap subs, downhole motors, underreamers, section mills, hydraulic disconnects, jars, vibration or dampening tools, casing drilling systems, liner drilling systems, other components, or combinations of the foregoing.

In accordance with embodiments of the present disclosure, the BHA 106 may include one or more directional drilling or survey tools. For instance, directional survey tools may be used to determine the direction (e.g., including one or more of azimuth or inclination) of the BHA or other downhole tools. The azimuth may be the orientation direction of a tool with respect to north. In some embodiments, the azimuth may be the orientation direction of the downhole tool with respect to one or more of magnetic north, true north, gravitational north, or grid north. The directional survey tool may include one or more magnetic survey tools used to detect the orientation of the BHA or other downhole tool with respect to magnetic north. The directional survey tool may include one or more gravitational survey tools used to detect the orientation of the BHA or other downhole tool with respect to gravitational north.

In some embodiments, the azimuth may be the orientation direction of the downhole tool with respect to true north. True north may be the location on the earth that corresponds to where the rotational axis of the earth extends through its outer surface. In some embodiments, true north may be aligned with the rotational axis of the earth. Basing the azimuth off true north may result in an accurate azimuth that is not affected (or not significantly affected) by the variations in the earth's magnetic field. Furthermore, downhole tools could include or be formed from magnetic material, which could introduce uncertainty into measurements using magnetic sensors. Basing the azimuth off true north may reduce uncertainties caused by magnetic interference with magnetic compasses and other magnetic sensors.

The BHA 106 may further include a directional drilling tool such as a rotary steerable system (RSS). The RSS may include directional drilling components that change a direction of the bit 110, and thereby the trajectory of the wellbore 102. Optionally, at least a portion of the RSS maintains a geostationary position relative to an absolute reference frame, such as one or more of gravity, magnetic, or true north. Using measurements obtained with the geostationary position, the RSS may locate the bit 110, change the course of the bit 110, and direct the BHA and other drilling tools on a projected or desired trajectory.

In some embodiments, a drilling operator may stop drilling operations to collect accurate and reliable survey measurements. This may include stopping rotation of the BHA or downhole tool, and thereby stopping advancement of the system during a drilling or other downhole operation.

In accordance with embodiments of the present disclosure, the survey tool may be located on a housing that is independently rotatable from the downhole tool. In some embodiments, the survey tool may be located on the BHA 106. In some embodiments, the survey tool may be located on its own independently rotatable downhole tool. To determine the earth rate component, the survey tool may collect one or both of gyroscopic or accelerometer measurements while the downhole tool is rotating. In some embodiments, the survey tool may be held stationary with respect to an external or absolute reference frame while the downhole tool is rotating. In some embodiments, the survey tool may rotate with respect to the absolute reference frame at a different rate than the downhole tool, and the survey tool may collect gyroscopic, accelerometer, or both gyroscopic and accelerometer measurements while rotating.

Using the collected measurements, an azimuth manager may determine the azimuth of the downhole tool. For example, the azimuth manager may determine a y-axis earth rate component using the gyroscopic measurements, accelerometer measurements, or both the gyroscopic and accelerometer measurements collected while rotating the survey tool. The azimuth manager may determine an x-axis earth rate component using an indexing gyroscope oriented along the length of the downhole tool. The azimuth manager may then use the x-axis earth rate component and the y-axis earth rate component to determine the azimuth of the downhole tool.

In some embodiments, as discussed further herein, by using multiple readings from the same gyroscope in different positions, the azimuth manager may remove any bias caused by misalignment. In some embodiments, as discussed further herein, the azimuth manager may use the inclination of the downhole tool to determine the x-axis and/or the y-axis earth rate component. In some embodiments, the azimuth manager may determine the azimuth using the inclination, the latitude, or both the inclination and latitude of the downhole tool.

In general, the drilling system 100 may include other drilling components and accessories, such as special valves (e.g., kelly cocks, blowout preventers, and safety valves). Additional components included in the drilling system 100 may be considered a part of the drilling tool assembly 104, the drill string 105, or a part of the BHA 106 depending on their locations in the drilling system 100.

The bit 110 in the BHA 106 may be any type of bit suitable for degrading downhole materials. For instance, the bit 110 may be a drill bit suitable for drilling the earth formation 101. Example types of drill bits used for drilling earth formations are fixed-cutter or drag bits. In other embodiments, the bit 110 may be a mill used for removing metal, composite, elastomer, other materials downhole, or combinations thereof. For instance, the bit 110 may be used with a whipstock to mill into casing 107 lining the wellbore 102. The bit 110 may also be a junk mill used to mill away tools, plugs, cement, other materials within the wellbore 102, or combinations thereof. Swarf or other cuttings formed by use of a mill may be lifted to surface, or may be allowed to fall downhole.

Figure 2:
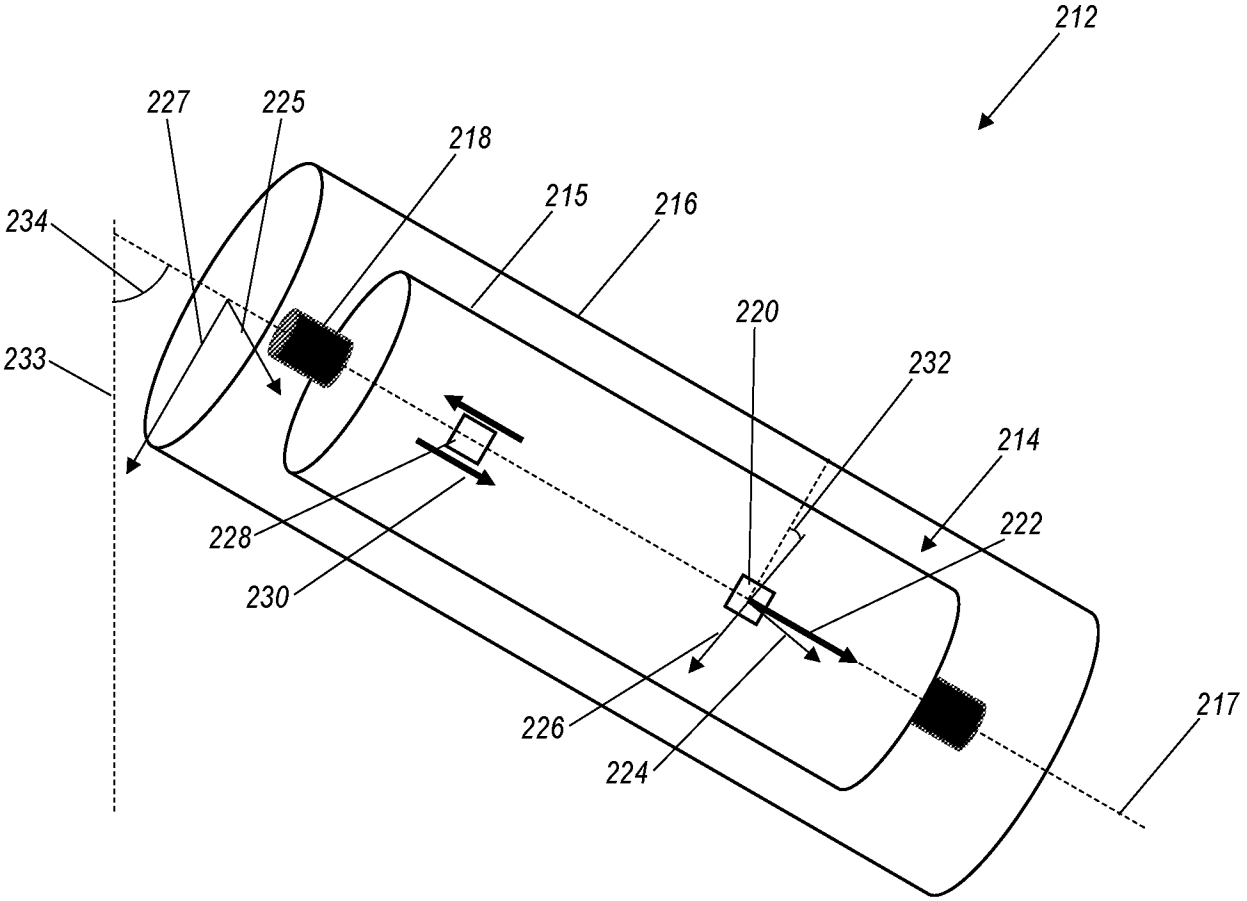
FIG. 2 is a representation of a downhole tool including a survey tool, according to at least one embodiment of the present disclosure.

FIG. 2 is a representation of a downhole tool 212 including a survey package 214, according to at least one embodiment of the present disclosure. The downhole tool 212 includes an outer housing 216. The outer housing 216 may be rotationally connected to the bit (e.g., the bit 110 of FIG. 1), the drill string (e.g., the drill string 105 of FIG. 1), or to some combination of the bit, BHA, drill string, or other downhole components. Put another way, the outer housing 216 may rotate with the same rotational rate as the bit, the drill string, or other BHA components (some of which may also be rotationally coupled to rotate with the same rotational rate). In some situations, the outer housing 216 may rotate about a tool rotational axis 217 with a rotational rate such as 50 RPM, 100 RPM, 200 RPM, 500 RPM, 1000 RPM, 2000 RPM, or rotational rates therebetween. In still other embodiments, the outer housing 216 may rotate about the tool rotational axis 217 at a rotational rate below 50 RPM or above 2000 RPM.

The survey package 214 is optionally located in an interior of the outer housing 216. In some embodiments, the survey package 214 may be located on an independently rotatable member 215. In some embodiments, the independently rotatable member 215 may be coaxial with the outer housing 216 and may rotate about the tool rotational axis 217. The independently rotatable member 215 (and therefore the survey package 214) may be rotationally stabilized with respect to the outer housing 216. Put another way, the survey package 214 may be independently rotatable to the outer housing 216. The independently rotatable member 215 may be connected to the outer housing 216 with one or more stabilizers 218, which may include one or more bearings used to change the rotational rate relative to the outer housing 216.

In some embodiments, the independently rotatable member 215 may have a counter-torque applied so that it rotates at a different rate than the outer housing 216. In some embodiments, the survey package 214 may rotate at a lower rate than the outer housing 216. In some embodiments, the survey package 214 may be maintained stationary with respect to an external reference, such as the force of gravity. As discussed herein, the independently rotatable member 215 may be considered to have independent rotation relative to a downhole tool, such as the outer housing 216 of a downhole tool. This may be due to the outer housing 216 having no influence on the rate of rotation of the independently rotatable member 215, such as where rotation of the independently rotatable member 215 is entirely decoupled from rotation of the outer housing 216. In other cases, however, the outer housing 216 may influence the rate of rotation of the independently rotatable member 215. For instance, although the rotation of the outer housing 216 may partially influence the rotation of the independently rotatable member 215, the independently rotatable member 215 can have a rotational rate that differs from that of the outer housing 216. For instance, a motor, clutch, or brake may be used to cause the independently rotatable member 215 to rotate at a rotational rate that is greater than or less than that of the outer housing 216.

The survey package 214 may include one or more survey instruments. For example, the survey package 214 may include a gyroscope assembly 220. The gyroscope assembly 220 may include one or more gyroscopes, such as a multi-axis gyroscope. The multi-axis gyroscope may collect gyroscopic measurements along one or more axes. The x-axis 222 may be parallel to the tool rotational axis 217, the z-axis 226 may be perpendicular to the x-axis 222 in the direction of the gravitational force, and the y-axis 224 may be perpendicular to both the x-axis 222 and the z-axis 226. In some embodiments, the multi-axis gyroscope may collect x-axis 222 gyroscopic measurements, y-axis 224 gyroscopic measurements, and z-axis 226 gyroscopic measurements. In some embodiments, the survey package 214, including the gyroscope assembly 220 may further include one or more accelerometers. In some embodiments, the accelerometers may collect x-axis 222 accelerometer measurements, y-axis 224 accelerometer measurements, and z-axis 226 accelerometer measurements. In some embodiments, the accelerometers may be housed with the gyroscope assembly 220. In this manner, the gyroscopic measurements and the accelerometer measurements may be taken close to each other, thereby improving the correlation between the two measurements.

In view of the present disclosure, it should be understood that the y-axis earth rate component 225 may be different from the y-axis 224 of the independently rotatable member 215. The y-axis 224 of the independently rotatably member 215 may rotate toward a global frame of reference, so the y-axis 224 of the rotatable member 215 may change over time. The y-axis earth rate component 225 is optionally defined as perpendicular to the x-axis 222 of the downhole tool and the axis 227, which is perpendicular to the x-axis 222 in a downward direction or direction of travel.

In some embodiments, the survey package 214 may further include an indexing gyroscope 228. The indexing gyroscope 228 may be oriented along the tool rotational axis 217. The indexing gyroscope 228 may collect measurements along an indexing axis 230 in a first direction and a second direction. As discussed in further detail herein, flipping the indexing gyroscope 228 along the indexing axis may help to compensate or remove bias in gyroscopic measurements caused by misalignment of the indexing gyroscope 228.

The downhole tool 212 has a tool face angle 232, which may be the angle between the z-axis 226 and a perpendicular axis 233 perpendicular to the tool rotational axis 217. As discussed further herein, the tool face angle 232 may be a reference angle for the determination of the tool azimuth of the downhole tool 212. The downhole tool 212 may further have an inclination 234, which may be defined by the angle between a perpendicular axis 233 and the tool rotational axis 217. As discussed herein, the inclination 234 may help to determine the tool azimuth of the downhole tool 212. The inclination 234 may be determined using the accelerometer measurements. In some embodiments, the inclination 234 may be determined using the accelerometer measurements and the gyroscopic measurements.

Figure 3:
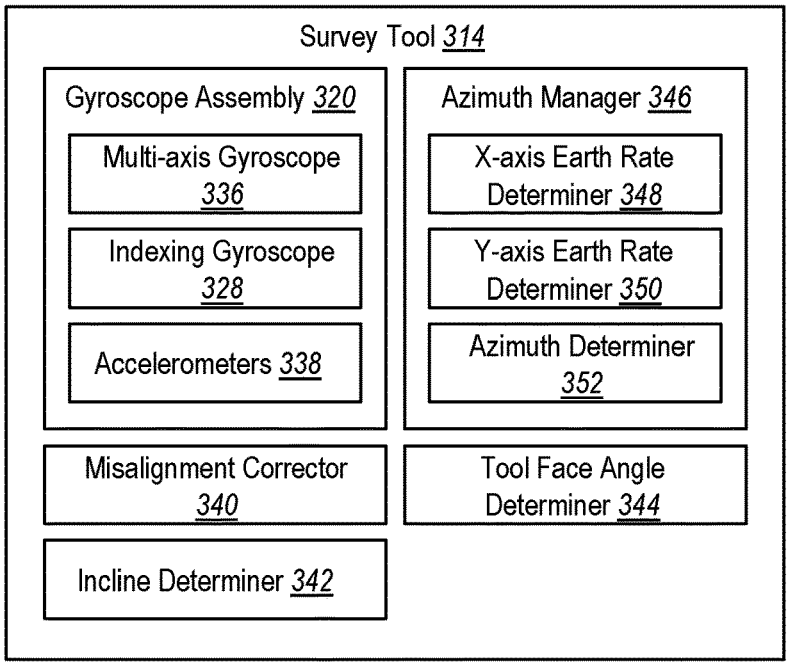
FIG. 3 is a representation of a survey tool, according to at least one embodiment of the present disclosure.

FIG. 3 is a representation of a survey tool 314, according to at least one embodiment of the present disclosure. The survey tool 314 includes a gyroscope assembly 320. The gyroscope assembly 320 may include a multi-axis gyroscope 336. The multi-axis gyroscope 336 may collect gyroscopic measurements along the x-axis, the y-axis, and the z-axis. The gyroscope assembly 320 may further include an indexing gyroscope 328. The indexing gyroscope 328 may be oriented along the tool rotational axis and collect measurements in two different directions along the tool rotational axis. The gyroscope assembly 320 may further include one or more accelerometers 338. The accelerometers 338 may collect accelerometer measurements along the x-axis, the y-axis, the z-axis, or combinations thereof.

The survey tool 314 may further include a misalignment corrector 340. The misalignment corrector 340 may use one or more of the gyroscopic measurements or the accelerometer measurements to correct for misalignment. For example, the misalignment corrector 340 may correct for misalignment on the multi-axis gyroscope 336 by cross correlating the gyroscopic measurements in a misalignment matrix. The misalignment corrector 340 may correct for misalignment on the indexing gyroscope 328 by subtracting differences in the gyroscope readings after the orientation of the indexing gyroscope 328 is flipped.

The incline determiner 342 may determine the inclination of the survey tool 314. The incline determiner 342 may determine the inclination using accelerometer measurements alone, or a combination of both accelerometer measurements and gyroscopic measurements.

The tool face angle determiner 344 may determine the rotational position of the survey tool 314. Using positional references, the accelerometer measurements, the gyroscopic measurements, or combinations thereof, the tool face angle determiner 344 may determine the tool face angle of the survey tool 314.

The survey tool 314 may further include an azimuth manager 346. The azimuth manager 346 may include an x-axis earth rate determiner 348 and a y-axis earth rate determiner 350. The x-axis earth rate determiner 348 may use the gyroscopic measurements from one or more of the indexing gyroscope 328, the multi-axis gyroscope 336, or the accelerometers 338, to determine the x-axis earth rate component. The y-axis earth rate determiner 350 may use the gyroscopic measurements from the multi-axis gyroscope 336, the accelerometer measurements, and the incline to determine the y-axis earth rate component. It should be understood that, as discussed herein, the y-axis earth rate component may be different from the y-axis of the independently rotatable member. The y-axis of the independently rotatably member may rotate toward a global frame of reference, so the y-axis of the rotatable member may change over time as the azimuth of the independently rotatable member changes. The y-axis earth rate component may be defined as perpendicular to the x-axis of the downhole tool and the z-axis, which is perpendicular to the x-axis in the downward direction. The azimuth determiner 352 may use the x-axis earth rate component and the y-axis earth rate component to determine the azimuth of the survey tool 314. In some embodiments, the azimuth determiner 352 may use the incline and the latitude of the survey tool 314 to determine the azimuth of the survey tool 314.

The azimuth manager 346 may be located on the survey tool 314. The processors and memory may be located on the survey tool 314 or other portions of the BHA, such as an MWD, LWD, or other portion of the BHA. Processors and memory may also be distributed among different components (e.g., the survey tool 314 and other portions of the BHA). Whether in a single tool or distributed among tools, the earth rate components, the tool azimuth, or combinations thereof, may in this manner be calculated downhole (e.g., at the BHA). The survey tool 314 or other portion of the BHA may use the determined tool azimuth to perform one or more operations, such as adjusting a trajectory of the downhole tool, adjusting downhole drilling parameters, activating or deactivating a downhole tool, communicating information to surface, advising a surface system of actions to take, and so forth. In some embodiments, the survey tool 314 or other portion of the BHA may perform the operation without input from a drilling operator on the surface, or without transmitting one or more of the measurements, the determined earth rate components, or the tool azimuth.

In some embodiments, the survey tool 314 may collect the measurements from the gyroscope and transmit them to a surface location. At the surface location, the azimuth manager 346 may determine the earth rate components and the tool azimuth. In some embodiments, the determined earth rate components, the determined tool azimuth, other measured/calculated parameters, or a combination thereof may be transmitted to the surface. The drilling operator may then use the determined tool azimuth to adjust one or more drilling parameters. In other embodiments, the determine earth rate components, the determined tool azimuth, or both may not be transmitted to the surface, but downhole decisions based or derived from the same may instead be transmitted to the surface.

Each of the components of survey tool 314 can include software, hardware, or both. For example, the components may include one or more instructions stored in memory or on a computer-readable storage medium and executable by processors of one or more computing devices, such as a client device or server device. The memory may include instructions which, when accessed or executed by the one or more processors, the computer-executable instructions of the survey tool 314 may cause the computing device(s) to perform all or portions of the methods and processes described herein. Additionally, or alternatively, the components can include hardware, such as a special-purpose processing device to perform a certain function or group of functions. The components of the survey tool 314 can further include a combination of computer-executable instructions, memory, and hardware.

Furthermore, the components of the survey tool 314 may, for example, be implemented as one or more operating systems, as one or more stand-alone applications, as one or more modules of an application, as one or more plug-ins, as one or more library functions or functions that may be called by other applications, as a cloud-computing model, or as or including combinations of the foregoing. Thus, the components may be implemented as a stand-alone application, such as an executable application on a downhole processor or operating system, as a desktop application, as a mobile application, and combinations thereof. Furthermore, the components may be implemented as one or more web-based applications hosted on a remote server. The components may also be implemented as answer products, or in a suite of mobile device applications or "apps."

Figure 4:
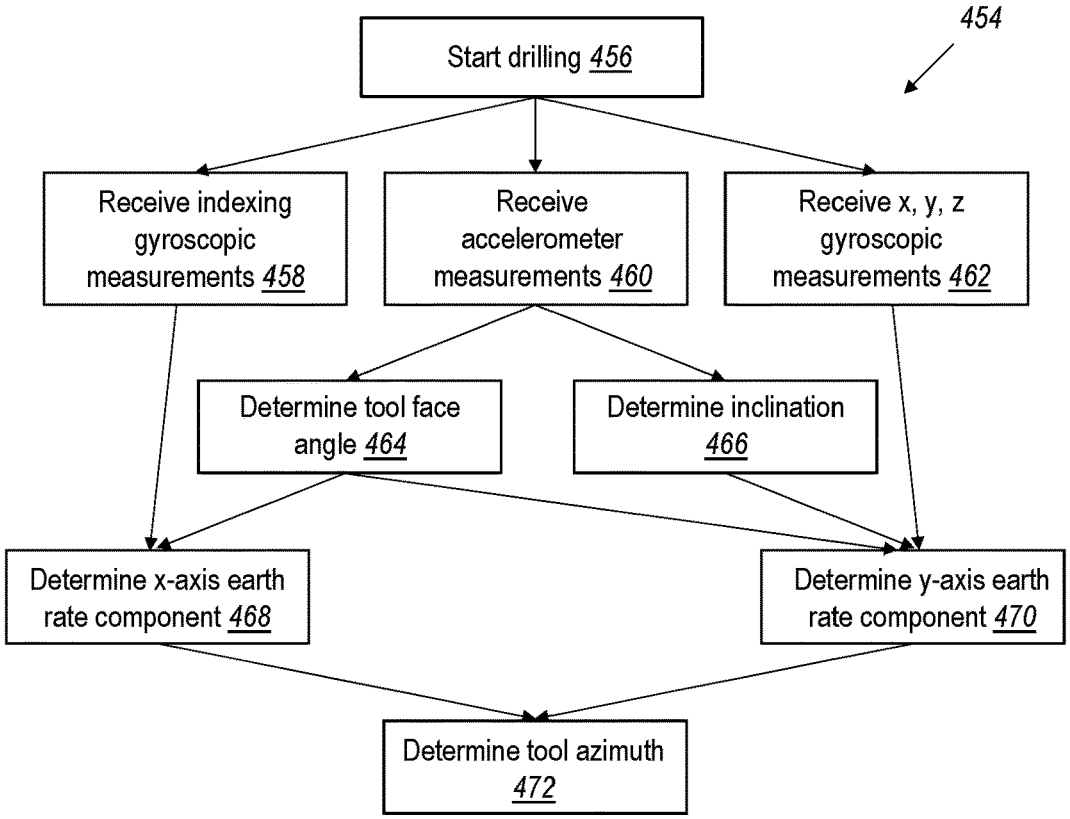
FIG. 4 is a flow chart of a method for performing a downhole survey, according to at least one embodiment of the present disclosure.

FIG. 4 is a flowchart of a method 454 for performing a downhole survey, according to at least one embodiment of the present disclosure. In accordance with embodiments of the present disclosure, the method 454 may be performed fully or partially by or using a survey tool such as the survey tool 314 of FIG. 3.

The method 454 may include starting drilling at 456. Starting drilling may include starting any drilling activity. In some embodiments, starting drilling may include initiating rotation of the drill string, a coiled tubing system, the outer housing of the downhole tool, or the like. Starting drilling at 456 can include, for instance, initiating rotation of a BHA that includes a survey tool such as survey tool 314 of FIG. 3. In some embodiments, the entire method 454 may be performed during active drilling operations, such as while an outer housing is rotating. In accordance with embodiments of the present disclosure, the survey tool may determine the tool azimuth of the downhole tool while the outer housing is rotating at a different rate than the survey tool. For example, the survey tool may be stationary with respect to an external reference. In some embodiments, the survey tool may be rotating at a lower rate than the outer housing; however, it should be understood that the method 454 may be performed while the outer housing is not rotating.

The survey tool may collect or otherwise receive indexing gyroscopic measurements at 458, collect or otherwise receive accelerometer measurements at 460, and collect or otherwise receive any or each of x-axis, y-axis, and z-axis gyroscopic measurements at 462. In some embodiments, the survey tool may collect or otherwise receive the measurements simultaneously, or at nearly the same time. In some embodiments, the survey tool may collect or otherwise receive the measurements in a time stamped manner so that the measurements may be correlated with each other when determining the earth rate components, the tool azimuth, or combinations thereof.

In accordance with embodiments of the present disclosure, the survey tool may collect or otherwise receive gyroscopic measurements while the downhole tool is rotating. In some embodiments, the survey tool may collect or otherwise receive the gyroscopic measurements while the survey tool is rotating independently of the downhole tool. For example, the survey tool may collect or otherwise receive the gyroscopic measurements while the survey tool is held stationary with respect to an external reference, such as the force of gravity. In some embodiments, the survey tool may collect or otherwise receive the gyroscopic measurements while the survey tool is rotated at a different (e.g., lower) rotational rate than the downhole tool. In some embodiments, the survey tool may collect or otherwise receive the gyroscopic measurements and determine the earth rate components continuously. In some embodiments, the survey tool may collect or otherwise receive the gyroscopic measurements across a range of tool face angles. For example, the survey tool may collect or otherwise receive the gyroscopic measurements while the survey tool transits across a range of tool face angles. In some embodiments, the range of tool face angles may be in a range having an upper value, a lower value, or upper and lower values including any of 10°, 20°, 30°, 45°, 60°, 90°, 120°, 150°, 180°, 270°, 360°, 720°, 1080°, 1440°, 1800°, 3600°, 7200° or any value therebetween. For example, the range of tool face angles may be greater than 10°. In another example, the range of tool face angles may be less than 7200°. In some examples, the range of tool face angles may be greater than 7200° In yet other examples, the range of tool face angles may be any value in a range between 10° and 7200°. In some embodiments, it may be critical that the range of tool face angles is greater than 90° to collect enough measurements to correct for instrument bias. In some embodiments, it may be critical that the range of tool face angles is greater than 3600° to collect enough measurements to correct for instrument bias.

Using the accelerometer measurements (and, optionally, the indexing gyroscopic measurements; the x-axis, y-axis, or z-axis gyroscopic measurements; or combinations thereof), the survey tool may determine the face angle of the downhole tool at 464 and the inclination of the downhole tool at 466. Using the tool face angle and the indexing gyroscopic measurements, the survey tool may determine the x-axis earth rate component at 468. In some embodiments, using the tool face angle, the inclination, and the x-axis, y-axis, and z-axis gyroscopic measurements, the survey tool may determine the y-axis earth rate component at 470. In some embodiments, the survey tool may use the x-axis earth rate component and the y-axis earth rate component to determine the tool azimuth at 472.

In accordance with embodiments of the present disclosure, the drilling operator, the downhole tool, any other downhole tool, the BHA, other component of the drilling assembly, and combinations thereof may perform one or more drilling actions based on the determined tool azimuth. For example, the drilling operator, one or more components of a downhole tool, or combinations of downhole tool components and drilling operators may adjust at least one drilling parameter based on the determined tool azimuth. In some examples, the drilling operator may adjust a timing, force, extension, or other action or component of steering pads of the RSS (or combinations of actions or components). In some examples, the drilling operator may adjust a fluid flow rate, the drilling mud composition, the RPM, any other drilling parameter, and combinations thereof. In some examples, the drilling operator may activate or deactivate a downhole tool based on the determined tool azimuth. In some embodiments, the drilling operator may stop drilling activities based on the determined azimuth. In some embodiments, the drilling operator may trip the BHA out of the wellbore based on the determined azimuth.

Figure 5:
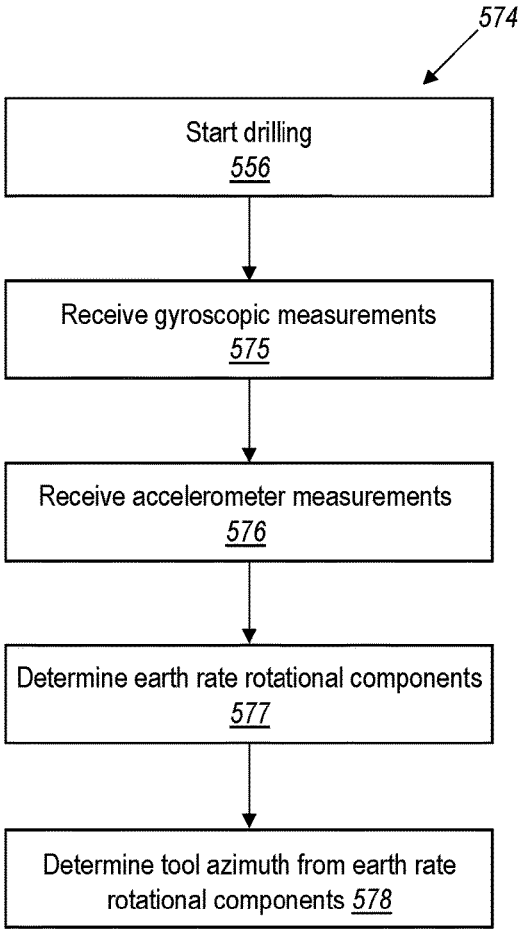
FIG. 5 is a flow chart of a method for performing a downhole survey, according to at least one embodiment of the present disclosure.

FIG. 5 is a flowchart of a method 574 for performing a downhole survey, according to at least one embodiment of the present disclosure. In accordance with embodiments of the present disclosure, the method 574 may be fully or partially performed by or using a survey tool such as the survey tool 314 of FIG. 3.

The method 574 may include starting drilling at 556. Starting drilling at 556 can include, for instance, starting drilling activities, rotating the downhole tool, advancing the downhole tool, initiating mud flow for drilling activities, and the like. While performing drilling activities, the survey tool may receive gyroscopic measurements at 575. For example, the survey tool may receive any or each of x-axis, y-axis, and z-axis gyroscope measurements. In some examples, the survey tool may receive reciprocating gyroscope measurements. While performing drilling activities, the survey tool may receive accelerometer measurements at 576.

Using the received gyroscopic measurements, the survey tool may determine the earth rate components of the downhole tool's rotation at 577. Using the earth rate rotational components, the survey tool may determine the tool azimuth at 578.

Figure 6:
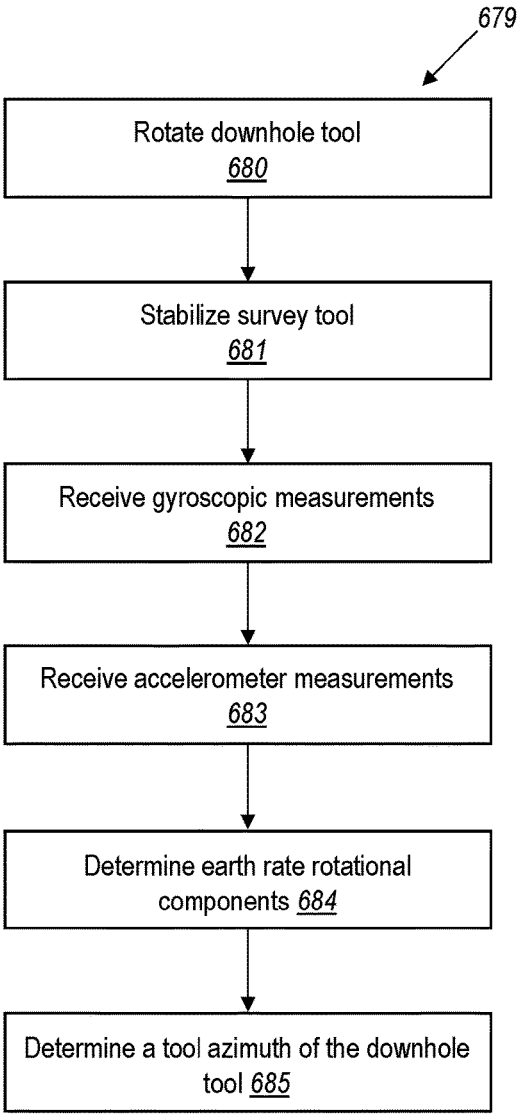
FIG. 6 is a flow chart of a method for performing a downhole survey, according to at least one embodiment of the present disclosure.

FIG. 6 is a flowchart of a method 679 for performing a downhole survey, according to at least one embodiment of the present disclosure. In accordance with embodiments of the present disclosure, the method 679 may be performed by the survey tool 314 of FIG. 3. Put another way, the survey tool 314 may perform the method 679.

The method 679 may include rotating a downhole tool at 680. While rotating the downhole tool, the survey tool may be stabilized at 681. For example, as discussed herein, the survey tool may be connected to or part of the RSS and may be stabilized relative to an external reference frame. In some embodiments, the survey tool may be rotated at a lower rotational rate than the downhole tool. The survey tool may receive gyroscopic measurements at 682. In some embodiments, the survey tool may receive gyroscopic measurements while the downhole tool is rotating. In some embodiments, the survey tool may receive gyroscopic measurements while the survey tool is rotating at a different rotational rate than the downhole tool. In some embodiments, the survey tool may receive accelerometer measurements at 683.

Using the gyroscopic measurements and the accelerometer measurements, the survey tool may determine the earth rate rotational component at 684. In some embodiments, using the earth rate rotational components, the survey tool may determine a tool azimuth of the downhole tool at 685.

Figure 7:
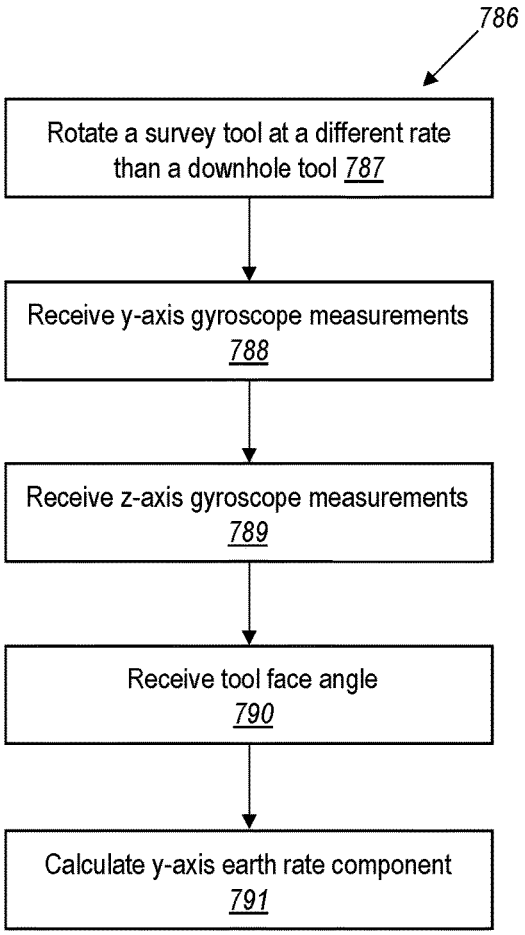
FIG. 7 is a flow chart of a method for determining the y-axis earth rate component, according to at least one embodiment of the present disclosure.

FIG. 7 is a flowchart of a method 786 for determining the y-axis component of the earth rate rotation of a downhole tool, according to at least one embodiment of the present disclosure. In accordance with embodiments of the present disclosure, the method 786 may be performed by the survey tool 314 of FIG. 3. Put another way, the survey tool 314 may perform the method 786.

The method 786 may include rotating a survey tool at a different rate than a downhole tool at 787. While rotating the survey tool at the different rate, the survey tool may receive y-axis gyroscope measurements from a multi-axis gyroscope at 788. In some embodiments, the survey tool may receive z-axis gyroscope measurements from the multi-axis gyroscope at 789. The survey tool may further receive the tool face angle at 790. Using the y-axis gyroscope measurements, the z-axis gyroscope measurements, and the tool face angle, the survey tool may calculate the y-axis earth rate component at 791.

In accordance with embodiments of the present disclosure, the relationship between the y-axis gyroscopic measurements and the tool face angle may be expressed as:

$$\hat{\omega}_{yi} = W_Y \cos\phi_i + W_Z \sin\phi_i + b_y \quad [1]$$

where $\omega_{yi}$ is the y-axis gyroscopic measurements, $W_Y$ is the y-axis earth rate component, $W_Z$ is the z-axis earth rate component, $\phi_I$ is the tool face angle of the survey tool, and by is the y-axis misalignment bias. The relationship between the z-axis gyroscopic measurements and the tool face angle may be expressed as:

$$\hat{\omega}_{zi} = -W_Y \sin(\phi_i) + W_Z \cos(\phi_i) + b_z \quad [2]$$

where $\omega_{zi}$ is the z-axis gyroscope measurements. Equations 1 and 2 may be solved to determine $W_Y$.

In accordance with embodiments of the present disclosure, $\omega_{yi}$ and $\omega_{zi}$ may be average gyroscopic measurements. For example, the survey tool may be rotated while collecting gyroscopic measurements. In some embodiments, the survey tool may be rotated through a whole rotation while collecting gyroscopic measurements. In some embodiments, the survey tool may be rotated through multiple rotations while collecting gyroscopic measurements, including 1, 2, 3, 4, 5, 6, 7, 8, 9, 10, 15, 20, or more rotations. In some embodiments, the survey tool may be rotated through a partial rotation, such as 180°, 90°, 45°, or any other partial rotation. The average gyroscopic measurement may be used as $\omega_{yi}$ and $\omega_{zi}$. In some embodiments, multiple average gyroscopic measurements may be used to solve equations 1 and 3 for $W_Y$.

In some situations, the multi-axis gyroscope may become misaligned during installation. The survey tool may correct the $\omega_{yi}$ and $\omega_{zi}$ values for misalignment. For example, a misalignment matrix may be used to solve for the misalignment of the multi-axis gyroscope. The misalignment matrix may be presented below:

$$\begin{pmatrix} \omega_{xm} \\ \omega_{ym} \\ \omega_{zm} \end{pmatrix} = \begin{pmatrix} 1 & \varepsilon_{xy} & \varepsilon_{xz} \\ \varepsilon_{xy} & 1 & \varepsilon_{yz} \\ \varepsilon_{xz} & \varepsilon_{yz} & 1 \end{pmatrix} \begin{pmatrix} \omega_{xt} \\ \omega_{yt} \\ \omega_{zt} \end{pmatrix} \quad [3]$$

where $\omega_{xm}$ is the measured x-axis gyroscopic measurement, $\omega_{ym}$ is the measured y-axis gyroscopic measurement, $\omega_{zm}$ is the z-axis gyroscopic measurement, $\omega_{xt}$ is the corrected x-axis gyroscopic measurement, $\omega_{yt}$ is the corrected y-axis gyroscopic measurement, $\omega_{zt}$ is the corrected z-axis gyroscopic measurement, $\varepsilon_{xy}$ is the misalignment in the x-y plane, $\varepsilon_{xz}$ is the misalignment in the x-z plane, $\varepsilon_{yz}$ is the misalignment in the y-z plane, and $\varepsilon_{xz}$ is the misalignment in the x-z plane. Equation 3 may then be used to determine the amount of misalignment. For example, the misalignment may be determined by cross-correlation or by any other mechanism. In some embodiments, the survey tool may perform the misalignment compensation before calculating the y-axis earth rate component.

In accordance with embodiments of the present disclosure, the y-axis earth rate component may be affected the change in inclination. In some embodiments, the compensated earth rate component may be adjusted by subtracting the rate of change in the inclination over time, as shown below:

$$\Omega_Y = W_Y - \frac{\Delta I}{\Delta t} \quad [4]$$

where $\Omega_Y$ is the compensated earth rate component, $\Delta I$ is the change in inclination, and $\Delta t$ is the time over which the change in inclination is calculated. In some embodiments, the inclination, and therefore the change in inclination may be calculated using the accelerometer measurements.

Figure 8:
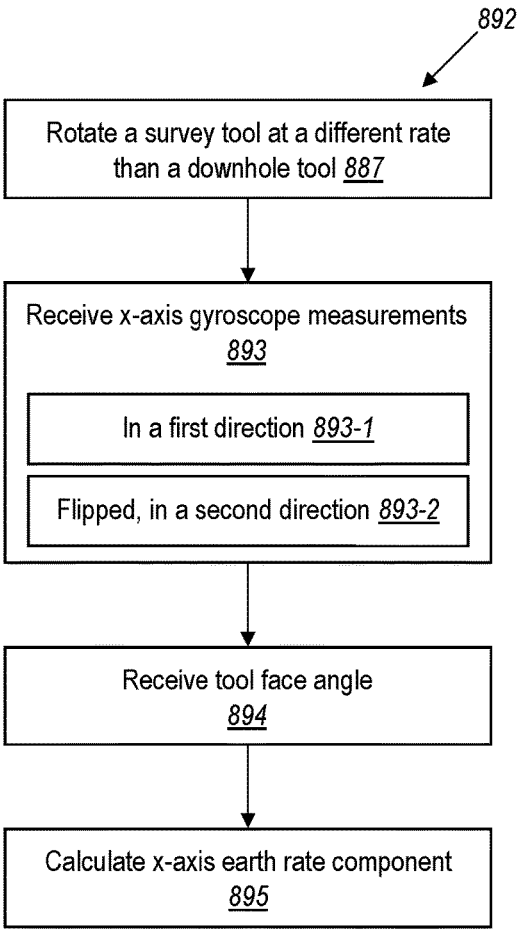
FIG. 8 is a flow chart of a method for determining the x-axis earth rate component, according to at least one embodiment of the present disclosure.

FIG. 8 is a flow chart of a method for determining the x-axis earth rate component, according to at least one embodiment of the present disclosure. In accordance with embodiments of the present disclosure, the method 892 may be performed by the survey tool 314 of FIG. 3. Put another way, the survey tool 314 may perform the method 892.

The method 892 may include rotating a survey tool at a different rate than a downhole tool at 887. While rotating the survey tool at the different rate, the survey tool may receive x-axis gyroscope measurements at 893. Optionally, the x-axis gyroscope measurements are obtained from a reciprocating gyroscope that can obtain measurements in a first direction at 893-1 and can be flipped to obtain measurements in a second direction at 893-2. In some embodiments, the survey tool may further receive the tool face angle at 894.

Using the x-axis gyroscope measurements and the tool face angle, the survey tool may calculate the x-axis earth rate component at 895.

In accordance with embodiments of the present disclosure, the reciprocating gyroscope may collect gyroscopic measurements in opposite directions. While embodiments of the present disclosure may discuss the reciprocating gyroscope as being aligned with the x-axis of the downhole tool, it should be understood that a reciprocating gyroscope may be oriented in any direction. For example, a reciprocating gyroscope may be oriented perpendicular to the x-axis. In some embodiments, more than one reciprocating gyroscope may be used. In some embodiments, three orthogonal reciprocating gyroscopes may be used. In some embodiments, using multiple reciprocating gyroscopes may allow the survey tool to determine the earth rate components without rotating the independently rotatable member. For example, a first reciprocating gyroscope aligned with x-axis may determine the x-axis earth rate component, a second reciprocating gyroscope aligned with the y-axis may determine the y-axis earth rate component, and a third reciprocating gyroscope aligned with the z-axis may help to correct for bias in one or both of the y-axis earth rate component and the x-axis earth rate component. Put another way, the change in tool face angle may be 0° for a system having multiple reciprocating gyroscopes.

Adding the two reciprocating gyroscopic measurements may cancel out bias in the reciprocating gyroscope. Such bias may be a result of misalignment in installation, manufacturing tolerances of the gyroscope, manufacturing tolerances of the gyroscope mount, any other bias, and combinations thereof. In some embodiments, the gyroscopic measurement may be:

$$\omega_u = \dot{\phi}_{ref} + \Omega_X + b \quad [5]$$

where $\omega_u$ is the reciprocating gyroscopic measurement, $\dot{\phi}_{ref}$ is the rate of change of the tool face angle or the speed of the change in the tool face angle change, $\Omega x$ is the earth rate component, and b is the reciprocating gyroscope bias. When flipped, the reciprocating gyroscopic may be:

$$-\omega'_u = \dot{\phi}_{ref} + \Omega_X - b \quad [6]$$

where $-\omega'_u$ is the flipped gyroscopic measurement. The azimuth manager may then determine the x-axis earth rate component using equations 5 and 6.

Using the x-axis earth rate components and the y-axis earth rate components, the azimuth manager may determine the azimuth of the downhole drilling tool.

$$\begin{pmatrix} \Omega_X \\ \Omega_Y \\ \Omega_Z \end{pmatrix} = \begin{pmatrix} \cos 90 - I & 0 & -\sin 90 - I \\ 0 & 1 & 0 \\ \sin 90 - I & 0 & \cos 90 - I \end{pmatrix} \begin{pmatrix} \cos\psi & \sin\psi & 0 \\ -\sin\psi & \cos\psi & 0 \\ 0 & 0 & 1 \end{pmatrix} \begin{pmatrix} \Omega\cos\lambda \\ 0 \\ -\Omega\sin\lambda \end{pmatrix} \quad [7]$$

where I is the inclination, $\psi$ is the drilling tool azimuth, and $\lambda$ is the latitude of the downhole drilling tool. The azimuth manager may solve equation 7 for $\psi$ to determine the downhole tool azimuth.

In various methods herein (e.g., methods 786 and 892 of FIGS. 7 and 8), a survey tool is rotated at a different rate than a downhole tool. Such embodiments are intended to expressly consider a survey tool that rotates with relative rotational movement when compared to both an absolute reference frame (e.g., magnetic north, gravitational north, true north) and to a relative or dynamic reference frame (e.g., a bit, BHA, RSS, or outer housing, or downhole tool), but also a survey tool that does not have rotation relative to an absolute reference frame but does have rotation relative to the dynamic reference frame of the downhole tool. By way of example, the survey tool can be said to be rotating when not geostationary in the wellbore (and thus rotating relative to an absolute reference frame) and while also rotating at a different rate than a downhole tool (and thus also rotating relative to a relative reference frame of the downhole tool). In another example, however, the survey tool should be understood to be rotating within the context of the described embodiments even while actively or passively maintained without significant rotation relative to an absolute reference frame (e.g., if geostationary in a wellbore) while a downhole tool rotates, thereby causing the survey tool to be seen as rotating relative to the relative reference frame of the downhole tool.

In some embodiments, the methods of the present disclosure may be executed by a computing system. For instance, a computing system may include a computer or computer system that is an individual computer system or an arrangement of distributed computer systems. The computer system can include one or more analysis modules that are configured to perform various tasks according to some embodiments, such as one or more methods disclosed herein. Example modules or computing systems may be in the form of special-purpose downhole tools (e.g., downhole directional drilling or survey tools). To perform these various tasks, the analysis module executes independently, or in coordination with, one or more processors, which are connected to one or more computer-readable media. The processors are optionally connected to a network interface to allow the computer system to communicate over a data network with one or more additional computer systems that may or may not share the same architecture, and may be located in different physical locations. For instance, one computer system may be located in an MWD or survey tool in a BHA, another may be in an RSS of the BHA, and still another may be in a drill bit or in surface equipment.

A processor may include a microprocessor, microcontroller, processor module or subsystem, programmable integrated circuit, programmable gate array, or another control or computing device. Additionally, while computer-readable media may be within a computer system, in some embodiments, computer-readable media may be distributed within and/or across multiple internal and/or external enclosures of a computing system and/or additional computing systems. The computer-readable media may be implemented as one or more computer-readable or machine-readable storage media, transmission media, or a combination of storage and transmission media.

As used herein, "storage media", "computer-readable storage media," and the like refer to physical media that stores software instructions in the form of computer-readable program code that allows performance of embodiments of the present disclosure. "Transmission media", "computer-readable transmission media," and the like refer to non-physical media which carry software instructions in the form of computer-readable program code that allows performance of embodiments of the present disclosure. Thus, by way of example, and not limitation, embodiments of the present disclosure can include at least two distinctly different kinds of computer-readable media, namely storage media or transmission media. Combinations of storage media and transmission media should be included within the scope of computer-readable media.

To further illustrate the distinct nature of storage media and transmission media, storage media may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories, magnetic disks such as fixed, floppy and removable disks, other magnetic media including tape, optical media such as compact disks (CDs) or digital video disks (DVDs), BLURAY® disks, other types of optical storage, other types of solid state drives, or other types of storage devices.

Transmission media may conversely include communications networks or other data links that enable the transport of electronic data between computer systems and/or modules, engines, and/or other electronic devices. When information is transferred or provided over a communication network or another communications connection (either hardwired, wireless, or a combination of hardwired or wireless) to a computing device, the computing device properly views the connection as a transmission medium. Transmission media can therefore include a communication network, data links, carrier waves, wireless signals, and the like, which can be used to carry desired program, code means, or instructions. For instance, electromagnetic signals, mud pulses, and the like used for telemetry purposes can be considered transmission media.

Note that the instructions discussed herein may be provided on one computer-readable or machine-readable medium, or may be provided on multiple computer-readable or machine-readable media distributed in a system having possibly plural nodes. Such computer-readable or machine-readable medium or media is (are) considered to be part of an article (or article of manufacture). An article or article of manufacture may refer to any manufactured single component or multiple components. The computer-readable medium or media may be located either in the machine or tool running the machine-readable instructions, or located at a remote site from which machine-readable instructions may be downloaded or accessed over a general or specialized network for execution. Further, where transmission media is used, upon reaching various computing system components, program code in the form of computer-executable instructions or data structures can be transferred automatically or manually from transmission media to storage media (or vice versa). For example, computer-executable instructions or data structures received over a network or data link can be buffered in memory-type storage media (e.g., RAM) within a network interface module (NIC), and then eventually transferred to computer system RAM and/or to less volatile storage media (e.g., a hard drive) at a computer system. Thus, it should be understood that storage media can be included in computer system components that also (or even primarily) utilize transmission media.

It should be appreciated that described computing systems are merely examples of computing systems, and that a computing system may have more or fewer components than described, may combine additional components not described, or may have a different configuration or arrangement of the components. The various components of a computing system may be implemented in hardware, software, or a combination of both hardware and software, including one or more signal processing and/or application specific integrated circuits.

Further, the steps in the processing methods described herein may be implemented by running one or more functional modules in information processing apparatus such as general purpose processors or application specific chips, such as ASICs, FPGAS, PLDs, or other appropriate devices. These modules, combinations of these modules, or their combination with general hardware are included within the scope of the present disclosure.

The embodiments of the downhole survey tool have been primarily described with reference to wellbore drilling operations; however, the downhole survey tool described herein may be used in applications other than the drilling of a wellbore. In other embodiments, downhole survey tools according to the present disclosure may be used in a wellbore logging, testing, simulation, production, or fracturing operation, or even outside a wellbore or other downhole environment used for the exploration or production of natural resources. For instance, downhole survey tools of the present disclosure may be used in a borehole used for placement of utility lines. Accordingly, the terms "wellbore," "borehole" and the like should not be interpreted to limit tools, systems, assemblies, or methods of the present disclosure to any particular industry, field, or environment.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A method for performing a downhole survey, comprising:

rotating a downhole tool;

stabilizing a survey package relative to the rotating downhole tool;

receiving gyroscopic measurements from the survey package, wherein the gyroscopic measurements include x-axis gyroscopic measurements, y-axis gyroscopic measurements, and z-axis gyroscopic measurements;

receiving accelerometer measurements from the survey package;

while rotating the downhole tool, determining a y-axis earth rate rotational component in a direction corresponding to a y-axis of the downhole tool from the y-axis gyroscopic measurements, the z-axis gyroscopic measurements, and a toolface angle of the downhole tool;

while rotating the downhole tool, determining an x-axis earth rate rotational component in a direction corresponding to an x-axis of the downhole tool from the x-axis gyroscopic measurements and the toolface angle of the downhole tool;

based on the y-axis earth rate rotational component and the x-axis earth rate rotational component, determining a tool azimuth of the downhole tool while the downhole tool is rotating; and adjusting a trajectory of the downhole tool using the tool azimuth.

2. The method of claim 1, further comprising adjusting at least one drilling parameter based on the tool azimuth.

3. The method of claim 1, further comprising correcting the gyroscopic measurements for misalignment of the survey package.

4. The method of claim 1, wherein the downhole tool includes an outer housing and an independently rotatable member, and wherein the survey package is located on the independently rotatable member, the method further comprising:

rotating the survey package relative to an external reference at a different rate than the downhole tool while the survey package collects the gyroscopic measurements and the accelerometer measurements.

5. The method of claim 1, wherein the survey package is located on a rotary steerable system or is communicatively coupled to the rotary steerable system.

6. The method of claim 1, wherein the x-axis earth rate rotational component is determined from x-axis gyroscope measurements in a first direction and flipped x-axis gyroscope measurements in a second direction.

7. The method of claim 1, wherein the y-axis earth rate component is determined over a range of tool face angles from y-axis gyroscope measurements and z-axis gyroscope measurements over the range of tool face angles.

8. The method of claim 1, wherein the y-axis earth rate component is based on a change in inclination of the downhole tool over time, wherein the change in inclination of the downhole tool over time is determined from the accelerometer measurements.

9. The method of claim 1, wherein the y-axis earth rate rotational component is determined from a first relationship between the y-axis gyroscopic measurements and tool face angle and a second relationship between the z-axis gyroscopic measurements and tool face angle.

10. The method of claim 9, wherein the first relationship is of the form:

$$\hat{\omega}_{yi}=W_y\cos(\varnothing_i)+W_z\sin(\varnothing_i)+b_y,$$

wherein $\hat{\omega}_{yi}$ is the y-axis gyroscopic measurements, $W_y$ is an uncompensated y-axis earth rate rotational component, $W_z$ is a z-axis earth rate rotational component, $\varnothing_i$ is the tool face angle, and by is a y-axis misalignment bias.

11. The method of claim 10, wherein the second relationship is of the form:

$$\hat{\omega}_{zi}=W_y\sin(\varnothing_i)+W_z\cos(\varnothing_i)+b_z,$$

wherein $\hat{\omega}_{zi}$ is the z-axis gyroscopic measurements, $W_y$ is an uncompensated y-axis earth rate rotational component, $W_z$ is a z-axis earth rate rotational component, $\varnothing_i$ is the tool face angle, and $b_z$ is a z-axis misalignment bias.

12. The method of claim 11, wherein the y-axis earth rate rotational component is determined by subtracting a change in inclination of the downhole tool over time from the uncompensated y-axis earth rate rotational component $W_y$, wherein the change in inclination of the downhole tool over time is determined from the accelerometer measurements.

13. A downhole drilling system, comprising:

a downhole tool including an outer housing;

a survey tool located in an interior of the outer housing, the survey tool being rotatable independent of the downhole tool, the survey tool including a gyroscopic sensor, and an accelerometer;

a processor and computer-readable storage media, the computer-readable storage media including instructions which, when accessed by the processor, cause the processor to perform operations while the survey tool is rotating independent of the downhole tool, wherein the operations include:

receiving x-axis gyroscopic measurements, y-axis gyroscopic measurements, and z-axis gyroscopic measurements from the gyroscopic sensor;

receiving a tool face angle of the downhole tool;

determining a y-axis earth rate rotational component in a direction corresponding to a y-axis of the downhole tool from the y-axis gyroscopic measurements, the z-axis gyroscopic measurements, and the toolface angle of the downhole tool;

determining an x-axis earth rate rotational component in a direction corresponding to an x-axis of the downhole tool from the x-axis gyroscopic measurements and the toolface angle of the downhole tool; and determining an azimuth of the downhole tool using the y-axis earth rate rotational component and the x-axis earth rate component; and adjusting a trajectory of the downhole tool using the azimuth.

14. The downhole drilling system of claim 13, wherein the survey tool is located on a rotary steerable system.

15. The downhole drilling system of claim 13, wherein the gyroscopic sensor includes a 3-axis gyroscope.

16. The downhole drilling system of claim 13, wherein the azimuth is determined using an inclination and a latitude of the downhole tool.

17. The downhole drilling system of claim 13, wherein the y-axis earth rate component is determined over a range of tool face angles from y-axis gyroscope measurements and z-axis gyroscope measurements over the range of tool face angles.

18. The downhole drilling system of claim 13, wherein the y-axis earth rate component is based on a change in inclination of the downhole tool over time, wherein the change in inclination of the downhole tool over time is determined from the accelerometer measurements.

* * * * *